US006738585B2

(12) United States Patent
Shin et al.

(10) Patent No.: US 6,738,585 B2
(45) Date of Patent: May 18, 2004

(54) IMAGE FORMING APPARATUS FOR AND METHOD OF COMPENSATING FOR VARIATION IN THICKNESS OF PHOTOSENSITIVE BODY AND DEVELOPMENT MASS PER AREA

(75) Inventors: Kyu-cheol Shin, Gyeonggi-do (KR); In-yong Song, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/246,695

(22) Filed: Sep. 19, 2002

(65) Prior Publication Data

US 2003/0147658 A1 Aug. 7, 2003

(30) Foreign Application Priority Data

Feb. 6, 2002 (KR) ..... 2002-6753

(51) Int. Cl.[7] ..... G03G 15/00
(52) U.S. Cl. ..... 399/26; 399/53
(58) Field of Search ..... 399/26, 46, 53, 399/55, 50, 24

(56) References Cited

U.S. PATENT DOCUMENTS 4,564,287 A 1/1986 Suzuki et al. ..... 399/43
5,160,967 A * 11/1992 Tonegawa ..... 399/26
5,943,526 A * 8/1999 Kodama ..... 399/26 X
5,943,532 A * 8/1999 Ohnuma ..... 399/299 X
6,014,530 A * 1/2000 Tsunemi ..... 399/53

FOREIGN PATENT DOCUMENTS

JP 09-101657 * 4/1997
JP 9146311 6/1997
JP 09-146311 * 6/1997
JP 10-232521 * 9/1998

* cited by examiner

*Primary Examiner*—Sophia S. Chen
(74) *Attorney, Agent, or Firm*—Staas & Halsey LLP

(57) ABSTRACT

An image forming apparatus for and a method of compensating for development mass per area includes a photosensitive body on which an electrostatic latent image for an image is formed, a charger charging the photosensitive body, a developing unit developing the electrostatic latent image of the photosensitive body, a measuring unit measuring a charge current flowing through the photosensitive body from the charger, a comparator comparing the charge current with a reference current, and a controller controlling a developing unit control variable so as to compensate for a variation in a thickness of the photosensitive body according to an output of the comparator. A time indicator of a display informs a user whether the photosensitive body has to be replaced, and deterioration of an image quality caused by a decrease in the thickness of the photosensitive body can be prevented when a potential of the developing unit is controlled.

28 Claims, 4 Drawing Sheets

IMAGE FORMING APPARATUS FOR AND METHOD OF COMPENSATING FOR VARIATION IN THICKNESS OF PHOTOSENSITIVE BODY AND DEVELOPMENT MASS PER AREA

CROSS-REFERENCE TO RELATED APPLICATIONS

This application claims the benefit of Korean Patent Application No. 2002-6753, filed Feb. 6, 2002 in the Korean Intellectual Property Office, the disclosure of which is incorporated herein by reference.

BACKGROUND OF THE INVENTION

1. Field of the Invention

The present invention relates to an image forming apparatus and a method thereof, and more particularly, to an image forming apparatus for and a method of controlling an image concentration.

2. Description of the Related Art

FIG. 1 illustrates an overall arrangement of a conventional image forming apparatus disclosed in U.S. Pat. No. 4,564,287. Referring to FIG. 1, the conventional image forming apparatus includes a photosensitive drum 1, a primary charger 2, a secondary charger 3, an entire surface exposure lamp 4, a potentiometer 7, a developing roller 5 of a developing unit, a transfer charger 28, a cleaner blade 35, and a discharger 29.

The photosensitive drum 1 is pre-discharged by the pre-discharge charger 29, and then, an entire surface of the photosensitive drum 1 is uniformly charged. A reflected light beam illuminated by an original exposure lamp 11 and reflected from an original image 10 is radiated on the photosensitive drum 1 through mirrors 12 and 13. In this case, an AC corona discharge or corona discharge having an opposite polarity to that of the primary charger 2 is performed by the secondary charger 3 to form an electrostatic latent image on the photosensitive drum 1 in accordance with the original image 10.

The entire surface of the photosensitive drum 1 is then exposed by the entire surface exposure lamp 4, so that the electrostatic latent image having a high contrast is formed. This latent image is then toner developed by the developing roller 5.

The transfer charger 28 is then operated to transfer the developed image to a recoding paper sheet (not shown). A blank exposure lamp 6 preventing an adhesion of excessive toner to the photosensitive drum 1 is disposed above the secondary charger 3 to form light color areas and dark color areas on the photosensitive drum 1 under a control with standard image formation conditions.

The potentiometer 7 measuring a surface potential of the photosensitive drum 1 is disposed between the entire surface exposure lamp 4 and the developing roller 5. A signal from the potentiometer 7 is supplied to an A/D converter 9 through a potential measurement circuit 8 and is converted into a digital signal by the A/D converter 9. This digital signal is supplied to a microcomputer 15.

An output from the microcomputer 15 is supplied to a D/A converter 16 and is connected to a light control circuit 17, a first high voltage control circuit 18, a second high voltage control circuit 19, a transfer control circuit 24, a pre-discharge control circuit 25, and a DC development bias control circuit 20. In an operation section 40 various key-in operations and display operations are performed.

The light control circuit 17 controls the original exposure lamp 11 through a lamp regulator 14. The first and second high voltage control circuits 18 and 19 are connected to the primary charger 2 and the secondary charger 3 through first and second high voltage transformers 21 and 22, respectively, to control respective charges of the primary and secondary chargers 2 and 3. The transfer control circuit 24 is connected to the transfer charger 28 through the transfer high voltage transformer 26.

The pre-discharge control circuit 25 is connected to the pre-discharge charger 29 through a pre-discharge high voltage transformer 27. An output from the DC development bias control circuit 20 is connected to an AC development bias control circuit 23, and an output from the AC development bias control circuit 23 is applied to the developing roller 5. A standard white board 38 is used to control a light amount of the original exposure lamp 11.

In the above conventional image forming apparatus, the surface potential of the photosensitive drum 1 is measured by the potentiometer 7, and a development bias of the developing roller 5 and charge potentials of the primary and second chargers 2, 3 are adjusted in accordance with a result of measurement of the surface potential of the photosensitive drum 1. However, since only the surface potential of the image forming apparatus is measured in prior art, a variation in an image concentration caused by a variation in the thickness of the photosensitive body cannot be measured, and thus a uniform image concentration cannot be achieved.

SUMMARY OF THE INVENTION

To solve the above and other problems, it is an object of the present invention to provide an image forming apparatus for preventing a decrease in an image concentration caused by a variation in a thickness of a photosensitive body.

Additional objects and advantageous of the invention will be set forth in part in the description which follows and, in part, will be obvious from the description, or may be learned by practice of the invention.

Accordingly, to achieve the above and other objects, according to an embodiment of the present invention,] there is provided an image forming apparatus. The apparatus includes a photosensitive body on which an electrostatic latent image for an image is formed, a charger charging the photosensitive body, a developing unit developing the electrostatic latent image of the photosensitive body, a measuring unit measuring a charge current flowing through the photosensitive body from the charger, a comparator comparing the charge current with a reference current, and a controller controlling a developing unit control variable so as to compensate for a variation in a thickness of the photosensitive body according to an output of the comparator.

According to an aspect of the present invention, the developing unit control variable is a development bias of the developing unit or a development vector, which is a difference between the development bias and an exposure potential of an exposure unit.

In order to achieve the above and other objects, according to another embodiment of the present invention, there is provided a method of compensating for the development mass per area caused by the thickness of the photosensitive body of the image forming apparatus. The method includes measuring a charge current $I_i$ of the photosensitive body, comparing the measured charge current $I_i$ with a first reference current $I_{rmin}$ of the photosensitive body, comparing the measured charge current $I_i$ with a second reference current $I_{rmax}$ in a case that the measured charge current $I_i$ is larger than the first reference current $I_{rmin}$, and replacing the photosensitive body with a new one in a case that the measured charge current $I_i$ is larger than the second reference current $I_{rmax}$, and performing an operation of the developing unit control variable and controlling the developing unit in an opposite case that the measured charge current $I_i$ is smaller than the second reference current $I_{rmax}$.

In the replacing of the photosensitive body with the new one, a command replacing the photosensitive body is transferred to a display.

According to another aspect of the present invention, in order to compensate for a variation in development mass per area caused by the thickness of the photosensitive body, the development mass per area is compensated by measuring the charge current of the photosensitive body and correcting the development bias in a case that the measured charge current is larger than a minimum reference current, and a high quality image can be obtained during a life span of a new photosensitive body by informing a user whether the photosensitive body has to be replaced in a case that the measured charge current is larger than a maximum reference current.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
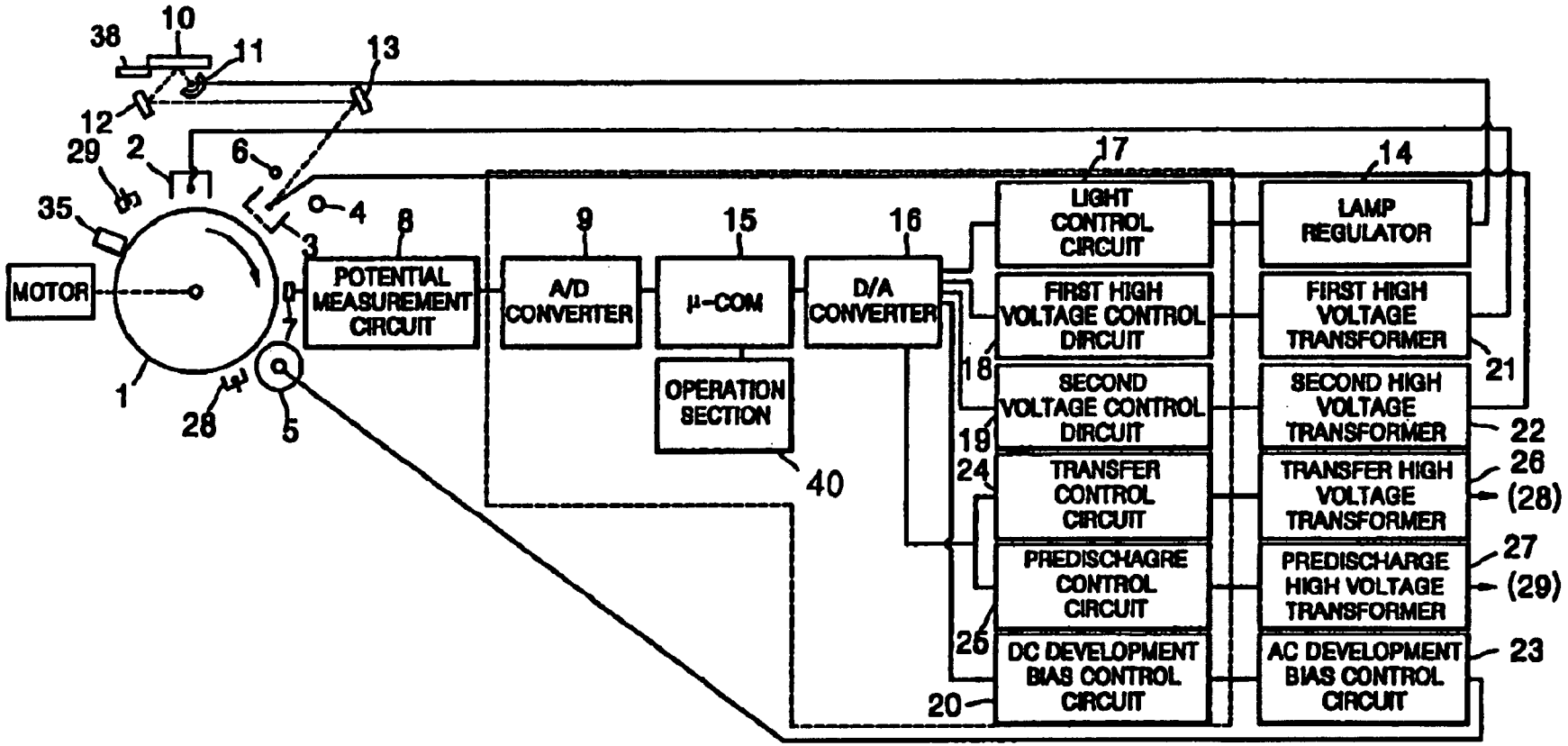
FIG. 1 (PRIOR ART)
FIG. 1 illustrates an overall arrangement of a conventional image forming apparatus.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

The present invention will be described more fully hereinafter with reference to the accompanying drawings in which embodiments of the invention are shown.

Figure 2:
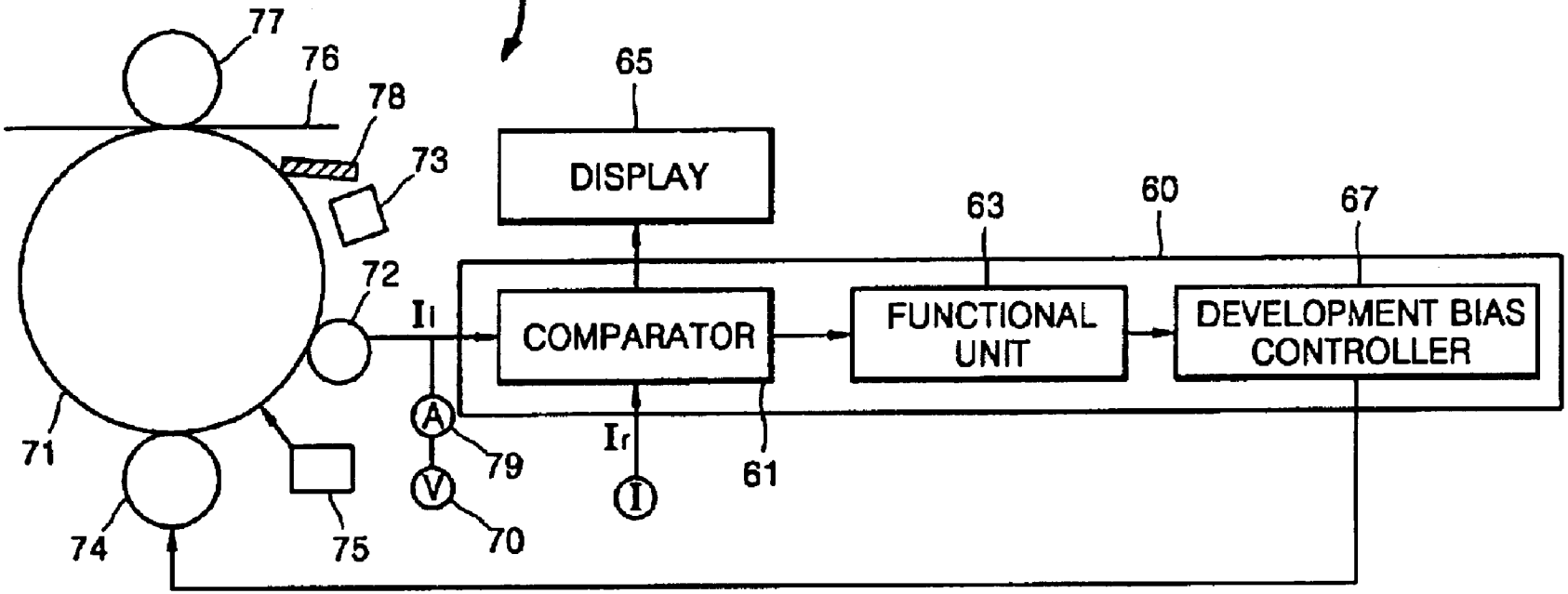
FIG. 2 is a block diagram illustrating a structure of an image forming apparatus according to an embodiment of the present invention.

FIG. 2 is a block diagram illustrating a structure of an image forming apparatus 200 according to a first embodiment of the present invention. Referring to FIG. 2, the image forming apparatus 200 includes a drum-type photosensitive body 71, a charging roller 72 of a charger increasing a surface potential of the photosensitive body 71 to a charge potential, an exposure unit 75 radiating light beam on the photosensitive body 71 passing through the charging roller 72 to form an electrostatic latent image on a surface of the photosensitive body 71, a developing roller 74 of a developing unit absorbing a developing solution to develop the electrostatic latent image, and a transfer roller 77 transferring the developed image onto a paper 76.

The image forming apparatus 200 includes a cleaning blade 78 cleaning the photosensitive body 71 and an eraser 73 erasing a potential of the surface of the photosensitive body 71. Also, an electrostatic voltage is applied to the charging roller 72 from an electrostatic voltage power supply 70.

The image forming apparatus 200 further includes a measuring unit 79, a regulator 60, and a display 65, so that a charge current caused by a variation in the thickness of the photosensitive body 71 is measured by the regulator 60, and the developing unit is controlled to compensate for the charge current, and a time indicator of the display 65 informs a user whether the photosensitive body 71 has to be replaced.

The measuring unit 79 is an ammeter measuring a current $I_i$ flowing to the charging roller 72 from the electrostatic voltage power supply 70 which supplies an electrostatic voltage to the charging roller 72.

The regulator 60 includes a comparator 61 comparing the measured charge current $I_i$ with a reference current $I_r$ of a lookup table that is stored in a main memory of the image forming apparatus, a functional unit 63 performing an operation of controlling a necessary development bias $V_B$ according to the measured charge current $I_i$, and a development bias controller 67 for receiving the development bias $V_B$ output from the functional unit 63 and controlling the developing roller 74.

Here, a development vector $V_D$, which is a difference between the development bias and an exposure potential, instead of the development bias $V_B$ may be selected as a variable for controlling the developing unit and will be described below.

As a using time of the image forming apparatus increases, the photosensitive body 71 becomes thinner. Also, as the photosensitive body becomes thinner, a capacitance C of the photosensitive body 71 increases. In a case that the capacitance C increases, the charge current more flows through the photosensitive body 71. As a result, an excessive developing solution is absorbed to the photosensitive body 71, development mass per area increases, and thus an image concentration increases. A variation in the thickness of the photosensitive body 71, which is a slight variation of the image forming apparatus, causes a large difference in the image concentration and affects an image quality.

The above principle will be described with reference to Equations 1 through 4.

$$Q/A=(Q/A)ink(M/A)dev=(C/A)opc\cdot V=I \quad (1)$$

$$C=\varepsilon\frac{A}{d} \quad (2)$$

$$Q=C\cdot V \quad (3)$$

$$Q=I\cdot t \quad (4)$$

Here, Q, M/A, d, I, and A represent a charge amount of toner, the development mass of the toner per area, the thickness of the photosensitive body 71, a current flowing through the photosensitive body 71, and an area of the photosensitive body 71, respectively. (C/A)opc and V represent a capacitance per area of the photosensitive body 71 and a potential of the photosensitive body 71, respectively.

A first term of Equation 1 represents the charge amount per area of ink and is equal to a multiplication of the charge amount per mass of ink with the development mass per area as shown in a second term of Equation 1. Also, a third term of Equation 1, which is the multiplication of the capacitance per area with the potential, is induced using Equation 3, and the first through third terms of Equation 1 representing the current are induced from Equation 4.

It can be seen from Equation 2 that the capacitance C is inversely proportional to the thickness "d" of the photosensitive body, and thus the capacitance C increases when the thickness "d" of the photosensitive body 71 decreases. It can be seen from Equation 1 that the charge current I flowing through the photosensitive body 71 increases when the capacitance C increases.

The image forming apparatus according to the first embodiment of the present invention includes a unit comparing the measured charge current $I_i$ with a minimum reference current $I_{rmin}$ and a maximum reference current $I_{rmax}$ and informing the user whether the photosensitive body 71 has to be replaced or controlling the development bias.

Figure 3:
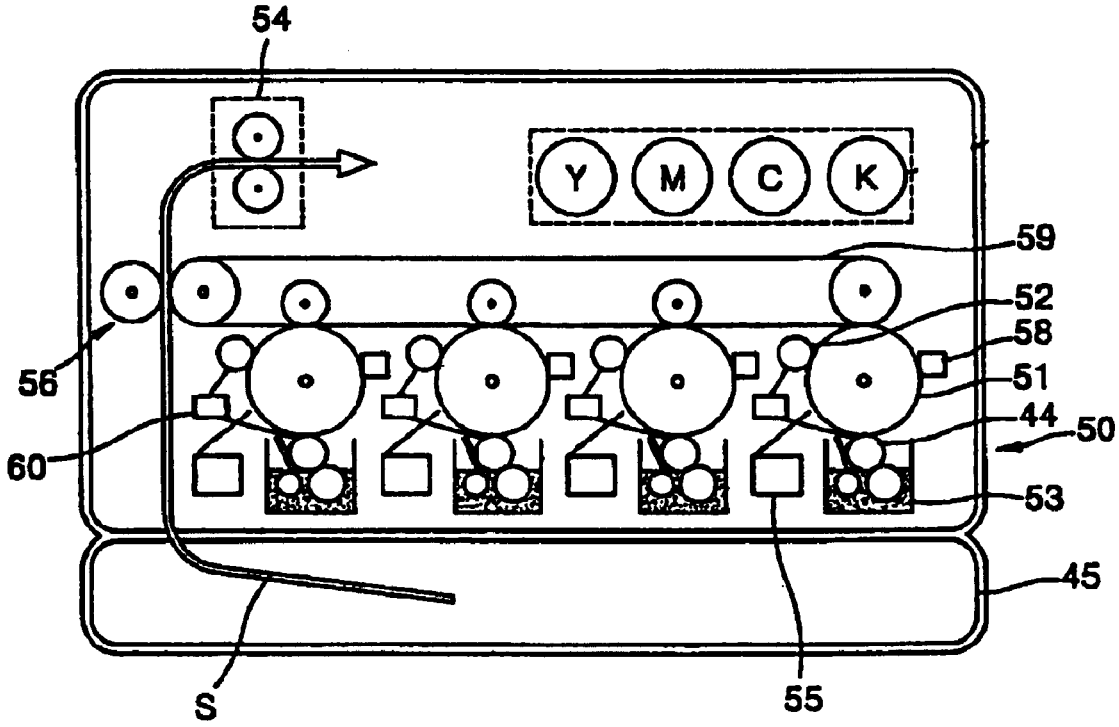
FIG. 3 illustrates an overall structure of an image forming apparatus according to another embodiment of the present invention.

FIG. 3 illustrates an overall structure of the image forming apparatus according to a second embodiment of the present invention.

Referring to FIG. 3, the image forming apparatus 50 includes a plurality of photosensitive bodies 51 on which electrostatic latent images having colors, such as yellow (Y), cyan (C), magenta (M), and black (K), are formed, a charging roller 52 increasing the surface potential of the photosensitive body 51 to the charge potential, an exposure unit 55 forming the electrostatic latent image by radiating light on the charged photosensitive body 51, a developing unit 53 developing the electrostatic latent image, a transfer belt 59 contacting the photosensitive body 51 and transferring the developed image, a transfer roller 56 transferring the image transferred from the transfer belt 59 onto paper S supplied from a paper cassette 45, a fixing unit 54 fixing the transferred image, and a regulator 60 for controlling the development bias of a developing roller 44 from the charge current that is measured by the charging roller 52. Here, the transfer belt 59 and the transfer roller 56 constitute a transfer unit. Each photosensitive body 51 has an associated cleaning section 58 which cleans the surface of the photosensitive body.

Figure 4:
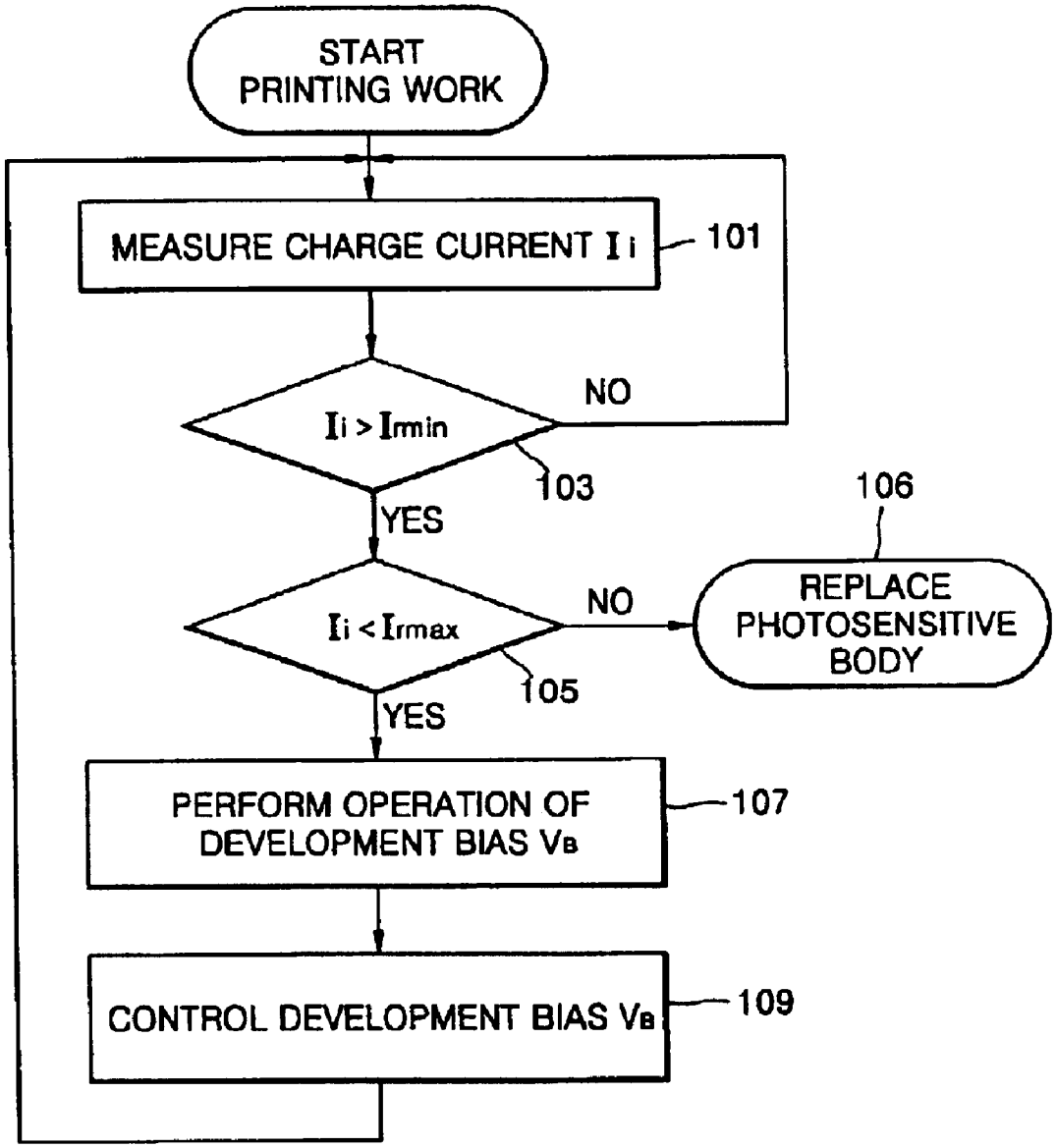
FIG. 4 is a flow chart illustrating a method of compensating for development mass per area in the image forming apparatus of FIGS. 3 and 4.

FIG. 4 is a flow chart illustrating a method of compensating for the development mass per area according to the first and second embodiments of the present invention. Referring to FIG. 4, a printing work starts, and then, in operation 101, the charge current $I_i$ flowing through the charging roller 52, 72 is measured. In operation 103, it is determined whether the charge current $I_i$ is larger than the minimum reference current $I_{rmin}$ stored in the lookup table. In a case that the measured charge current $I_i$ is larger than the minimum reference current $I_{rmin}$, operation 105 is performed, and in an opposite case that the charge current $I_i$ is smaller than the minimum reference current $I_{rmin}$ stored in the lookup table, the measuring of the charge current $I_i$ restarts.

In a case that the measured charge current $I_i$ is larger than the maximum reference current $I_{rmax}$, in operation 106, a time indicator of the display 65 informs the user whether the photosensitive body has to be replaced. In another case that measured charge current $I_i$ is smaller than the maximum reference current $I_{rmax}$, a variation in the development mass per area caused by a decrease in the thickness of the photosensitive body can be controlled by controlling the development bias $V_B$. Thus, in operation 107, the operation of controlling the development bias $V_B$ corresponding to the measured charge current $I_i$ is performed. In operation 109, the development bias controller 67 compensates for the development mass per area by applying the development bias $V_B$ required for the developing roller 44, 74 and controlling the development bias $V_B$.

Since the development bias $V_B$ is proportional to a development vector $V_D$, as shown in Equation 5, the development vector $V_D$ decreases when the regulator 60 decreases the development bias $V_B$. That is, a control variable may be the development vector $V_D$. Here, $V_L$ represents an exposure potential of the exposure unit 55, 75.

$$V_D = V_B - V_L \tag{5}$$

Referring to FIGS. 2 and 4, the operation 101 of measuring the charge current $I_i$ is performed by the measuring unit 79, and the operations 103 and 105 of comparing the measured charge current $I_i$ with the minimum and maximum reference current $I_{rmin}$ and $I_{rmax}$ are performed by the comparator 61. Also, the operation 107 of performing an operation of controlling the development bias $V_B$ is performed by the functional unit 63 according to a result of a comparison operation performed in the operations 103 and 105, and the operation 109 of controlling the development bias $V_B$ according to the result of operation is performed by the controller 67, thereby controlling the developing unit. Further, in a case that it is determined that the measured charge current $I_i$ is larger than the maximum reference current $I_{rmax}$ according to the result of the comparison operation performed in the operations 103 and 105, the operation 106 of displaying a command for replacing the photosensitive body 51, 71 is performed by being displayed on the display 65.

The image forming apparatus for and the method of compensating for the development mass per area according to the embodiments of the present invention can compensate for the development mass per area by controlling the development bias in a case that the measured charge current $I_i$ is between the minimum reference current $I_{rmin}$ and the maximum reference current $I_{rmax}$, and can replace the photosensitive body by informing to the user whether the photosensitive body has to be replaced by transferring a command for replacing the photosensitive body to the display in a case that the measured charge current $I_i$ is larger than the maximum reference current $I^{rmax}$, thereby obtaining a high quality image during a life span of the photosensitive body.

This invention has been particularly shown and described with reference to a few embodiments thereof, but this is not limited to the scope of the invention but should be interpreted as an example of preferred embodiments. In particular, it will be understood by those skilled in the art that a development potential can be precisely controlled by subdividing the reference current stored in the lookup table into a plurality of sub-currents.

As described above, the image forming apparatus for and the method of compensating for the development mass per area according to the embodiments of the present invention can compensate a variation in the development mass per area caused by a decrease in the thickness of the photosensitive body by measuring the charge current, comparing the measured charge current with the reference current, performing the operation of controlling the variable for controlling the developing unit and controlling the developing unit and can provide the high quality image during the life span of the photosensitive body by informing the user whether the photosensitive body has to be replaced.

While this invention has been particularly shown and described with reference to a few preferred embodiments thereof, it will be understood by those skilled in the art that various changes in form and details may be made therein without departing from the principles and sprit of the invention, the scope of which is defined in the claims and their equivalents.

What is claimed is:

1. An image forming apparatus comprising:

a photosensitive body on which an electrostatic latent image is formed;

a charger charging the photosensitive body;

a developing unit developing the electrostatic latent image of the photosensitive body with a developer;

a measuring unit measuring a charge current flowing through the photosensitive body from the charger;

a comparator comparing the charge current with a reference current; and a controller controlling a developing unit control variable of the developing unit so as to compensate for a variation in a thickness of the photosensitive body according to an output of the comparator when the measured charge current is less than the reference current and generating a message to replace the photosensitive body when the measured charge current is greater than the reference current.

2. The apparatus of claim 1, wherein the apparatus comprises an exposure unit, and the developing unit control variable of the developing unit is a development vector, which is a difference between a development bias of the developing unit and an exposure potential of the exposure unit.

3. The apparatus of claim 1, wherein the developing unit control variable is a development bias of the developing unit.

4. A method of compensating for development mass per area caused by a thickness of a photosensitive body in an image forming apparatus, the method comprising:

measuring charge current flowing from a charger to the photosensitive body;

comparing the measured charge current $I_i$ with a first reference current;

comparing the measured charge current $I_i$ with a second reference current when the measured charge current is larger than the first reference current; and generating a message to replace the photosensitive body when the measured charge current is larger than the second reference current, and performing an operation of controlling a developing unit control variable and a developing unit when the measured charge current is smaller than the second reference current.

5. The method of claim 4, wherein the generating of the message comprises transferring a command for replacing the photosensitive body to a display.

6. An image forming apparatus comprising:

a photosensitive body;

a charger charging the photosensitive body;

an exposure unit forming an electrostatic latent image on the charged photosensitive body;

a developing unit developing the electrostatic latent image of the photosensitive body with a developer; and a regulator measuring a thickness variation of the photosensitive body and controlling a developing potential of the developing unit in response to the thickness variation of the photosensitive body when the thickness variation is less than a reference amount and generating a message to replace the photosensitive body when the thickness variation is greater than a reference amount.

7. The apparatus of claim 6, wherein the regulator is connected to the charger to detect a signal representing the thickness variation of the photosensitive body when the charger charges the photosensitive body.

8. The apparatus of claim 6, wherein the regulator generates a charge amount of the developer per a unit area of the photosensitive body as the thickness variation of the photosensitive body.

9. The apparatus of claim 6, wherein the regulator generates a multiplication of a charge amount per a unit mass of the developer and a developer mass per a unit area of the photosensitive body as the thickness variation of the photosensitive body.

10. The apparatus of claim 6, wherein the regulator generates a multiplication of a capacitance per a unit area of the photosensitive body and the potential of the charger as the thickness variation of the photosensitive body.

11. The apparatus of claim 10, wherein the capacitance is inverse proportional to a thickness of the photosensitive body.

12. The apparatus of claim 6, wherein the thickness variation varies in accordance with a thickness of the photosensitive body.

13. The apparatus of claim 6, wherein the apparatus comprises a power supply unit supplying a charge potential to the photosensitive body through the charger, and the regulator comprises:

a measuring unit measuring a current of the potential representing the thickness variation of the photosensitive body.

14. The apparatus of claim 13, wherein the measuring unit comprises an ammeter coupled to the charger to detect the current.

15. The apparatus of claim 13, wherein the current varies in accordance with a variation of a thickness of the photosensitive body.

16. The apparatus of claim 13, wherein the regulator comprises:

a development bias controller controlling a developing potential of the developing unit in response to the measured current.

17. The apparatus of claim 16, wherein the regulator comprises:

a comparator comparing the measured current with a reference value, and the development bias controller controlling the developing potential of the developing unit in response to an output of the comparator.

18. The apparatus of claim 16, wherein the regulator comprises:

a functional unit generating a variable in accordance with an output of the comparator to control the development bias controller.

19. The apparatus of claim 6, wherein the regulator generates a difference between a charge potential of the charger and an exposure potential of the exposure unit and controls a developing potential of the developing unit in response to the difference representing the thickness variation of the photosensitive body.

20. The apparatus of claim 6, wherein the regulator reduces a difference between a developing potential of the developing unit and an exposure potential of the exposure unit when the thickness variation represents that a thickness of the photosensitive body decreases.

21. The apparatus of claim 6, wherein the apparatus comprises a display, and the regulator generates a message to be displayed on the display to alert a user to replace the photosensitive body with a new one when the thickness variation of the photosensitive body is greater than a reference value.

22. The apparatus of claim 6, wherein the regulator controls the developing unit to perform a developing operation in response to the thickness variation when the thickness variation of the photosensitive body is smaller than a reference value.

23. The apparatus of claim 6, wherein the apparatus comprises another photosensitive bodies, another chargers disposed adjacent corresponding photosensitive bodies, another developing units disposed adjacent to corresponding photosensitive bodies, and another regulators measuring a thickness variation of the corresponding photosensitive body from the corresponding charger and controlling the corresponding developing unit in accordance with the thickness variation of the corresponding photosensitive body.

24. The apparatus of claim 23, wherein the apparatus comprises a transfer belt receiving developed images from the photosensitive bodies to form a color image and having two opposite longitudinal surfaces and two opposite sides disposed on each end portion of the two opposite longitudinal surfaces, and the bodies, the chargers, and the developing units are disposed on one of the two opposite longitudinal surfaces of the transfer belt.

25. An image forming apparatus comprising:

a photosensitive body;

a charger charging the photosensitive body;

an exposure unit forming an electrostatic latent image on the charged photosensitive body;

a developing unit developing the electrostatic latent image of the photosensitive body with a developer; and a regulator measuring a thickness variation of the photosensitive body and controlling a developing potential of the developing unit in response to the thickness variation of the photosensitive body, wherein the regulator generates a multiplication of a charge amount per a unit mass of the developer and a developer mass per a unit area of the photosensitive body as the thickness variation of the photosensitive body.

26. An image forming apparatus comprising:

a photosensitive body;

a charger charging the photosensitive body;

an exposure unit forming an electrostatic latent image on the charged photosensitive body;

a developing unit developing the electrostatic latent image of the photosensitive body with a developer; and a regulator measuring a thickness variation of the photosensitive body and controlling a developing potential of the developing unit in response to the thickness variation of the photosensitive body, wherein the regulator generates a multiplication of a capacitance per a unit area of the photosensitive body and the potential of the charger as the thickness variation of the photosensitive body.

27. The apparatus of claim 26, wherein the capacitance is inverse proportional to a thickness of the photosensitive body.

28. An image forming apparatus comprising:

a photosensitive body;

a charger charging the photosensitive body;

an exposure unit forming an electrostatic latent image on the charged photosensitive body;

a developing unit developing the electrostatic latent image of the photosensitive body with a developer; and a regulator measuring a thickness variation of the photosensitive body and controlling a developing potential of the developing unit in response to the thickness variation of the photosensitive body, wherein the regulator generates a difference between a charge potential of the charger and an exposure potential of the exposure unit and controls a developing potential of the developing unit in response to the difference representing the thickness variation of the photosensitive body.

* * * * *